United States Patent [19]

Focke et al.

[11] Patent Number: 4,852,335

[45] Date of Patent: Aug. 1, 1989

[54] APPARATUS FOR PRODUCING (CIGARETTE) PACKS FROM AT LEAST ONE FOLDABLE BLANK

[75] Inventors: Heinz Focke, Verden; Wolfgang Oertel, Kirchlinteln, both of Fed. Rep. of Germany

[73] Assignee: Focke & Co. (GmbH & Co.), Verden, Fed. Rep. of Germany

[21] Appl. No.: 290,826

[22] Filed: Dec. 22, 1988

Related U.S. Application Data

[63] Continuation of Ser. No. 945,938, Dec. 23, 1986, abandoned.

[30] Foreign Application Priority Data

Dec. 23, 1985 [DE] Fed. Rep. of Germany ..... 3545884

[51] Int. Cl.[4] ..... B65B 19/24

[52] U.S. Cl. ..... 53/575; 53/234; 493/164; 493/910

[58] Field of Search ..... 53/148, 151, 234, 575; 493/164, 910, 911

[56] References Cited

U.S. PATENT DOCUMENTS

| | | | |
|---|---|---|---|
| 3,545,172 | 12/1970 | Osterdahl | 53/57 J |
| 3,553,925 | 1/1971 | Gianese | 53/148 X |
| 3,802,325 | 4/1974 | Bardenhagen | 53/148 X |
| 4,202,151 | 5/1980 | Focke | 53/234 X |
| 4,330,976 | 5/1982 | Blackall | 53/234 X |
| 4,351,142 | 9/1982 | Focke | 53/57 J |
| 4,548,019 | 10/1985 | Keuse | 53/234 X |
| 4,581,004 | 4/1986 | Nagate | 53/234 X |
| 4,605,390 | 8/1986 | Nagata | 53/234 X |

*Primary Examiner*—John Sipos

*Attorney, Agent, or Firm*—Sughrue, Mion, Zinn, Macpeak & Seas

[57] ABSTRACT

Apparatus for producing packs from at least one foldable blank, especially soft-cup cigarette packs, in which, in a transfer station, individual blanks can be fed by means of a feed unit with a blank-holder to a receptacle (hollow mandrel) of a folding turret and can be transported by this in order to make folds, each blank (21, 22) for taking up by a receptacle (hollow mandrel 23) of the folding turret (20) is held so as to project freely on one side by the blank-holder (holding disc 68) fixed in place and arranged outside the path of movement of the receptacles (23).

29 Claims, 12 Drawing Sheets

APPARATUS FOR PRODUCING (CIGARETTE) PACKS FROM AT LEAST ONE FOLDABLE BLANK

This is a continuation of application Ser. No. 945,938 filed Dec. 23, 1986, now abandoned.

BACKGROUND OF THE INVENTION

The invention relates to an apparatus for producing packs from at least one foldable blank, especially soft-cup cigarette packs, in which, in a transfer station, the individual blanks can be fed by means of a feed unit with a blank-holder to one of several receptacles (hollow mandrels) of a folding turret and can be transported by the latter in order to make folds.

High-performance packaging machines are required for producing (folding) and filling cigarette packs. Particularly high demands are made of machines for producing soft-cup cigarette packs. This type of pack consists of an inner wrapping, especially a tinfoil blank, which surrounds the cigarette group, as the contents of the pack, on all sides. The tinfoil block formed in this way is accommodated in a cup produced from a paper blank which is open at the top or on the end face.

Packaging machines for producing this type of pack are predominantly equipped with a folding turret which has a plurality of receptacles arranged along the periphery in the form of hollow mandrels. These are elongate receptacles of rectangular cross-section for the inner (tinfoil) blank and subsequently for the paper blank. The blanks are wrapped round the stationary hollow mandrel and then, together with the cigarette group previously introduced into the hollow mandrel, are drawn off from the hollow mandrel in the longitudinal direction.

Hitherto-known packaging machines for soft-cup packs and similar types of pack have a limited production capacity, above all because the complex folding turret is driven intermittently.

SUMMARY OF THE INVENTION

The object on which the invention is based is, therefore, to improve a packaging machine of the type mentioned in the introduction in terms of production capacity, without at the same time tolerating losses as regards the quality of the packs or the treatment of the pack contents (cigarette groups).

To achieve this object, the apparatus according to the invention is characterised in that the blank, in order to be taken up by the receptacle of the folding turret (hollow mandrel), is held so as to project freely on one side by the blank-holder arranged outside the path of movement of the receptacles.

To increase the production capacity of the packaging machine according to the invention, measures are taken to allow a continuous rotation of important packaging units, particularly the folding turret. Doing away with standstill phases of the folding turret first makes it necessary to adopt an appropriately adapted method of feeding the blanks, namely the tinfoil blank on the one hand and the paper blank on the other hand, to the respective hollow mandrels on the folding turret. According to the invention, the blanks are conveyed into the (circular) path of movement of the hollow mandrels arranged at a distance from one another on the folding turret, specifically by means of a blank-holder which is fixed in place next to the path of movement of the hollow mandrels and which brings the blank into the position for it to be received by one of the constantly revolving hollow blanks.

According to the invention, for this purpose the blank-holder is designed as a circular holding disc driven to rotate, with suction bores on the peripheral surface. The intermittently driven holding disc, stationary during the reception of a blank by a hollow mandrel, grasps a blank solely in the region of an edge strip. The blank is held in the transfer position in such a way that the revolving hollow mandrel grasps the blank from the rear side and takes it up, whilst at the same time drawing it off from the holding disc. It is important to ensure, here, that the blank assumes a three-dimensional shape on the holding disc, in particular that of a part cylinder. As a result, the blank consisting of thin material is prepared, free of folds, to be taken up by the hollow mandrel.

The blank-holder (holding disc) and blank-conveyors preceding this are designed so that the blanks can be delivered at high speed and brought into position according to the production capacity. For this, the blank is accelerated after being severed from a sheet of material. The blank is held on the blank-conveyors by means of suction which is controlled so that the blank is conveyed and transferred from one blank-conveyor to the next accurately and at high speed.

The continuously revolving folding turret is designed so that, in the course of one revolution of the folding turret, the pack (soft-cup pack) can be completed, with the exception of the end fold of the tinfoil blank, and pushed off from the hollow mandrel together with the pack content (cigarette group).

For this purpose, the folding turret is equipped with a plurality of movable pressing members which are assigned to each hollow mandrel and which, during the reception of the blank by a hollow mandrel and during the folding operations, fix the blank on the hollow mandrel at various points. The respective pressing members are assigned, on the one hand, to narrow side faces extending at the front and rear in the revolving direction and to an inner face of the hollow mandrel corresponding to the front side of the pack. The respective pressing members are designed so as to be movable to and fro in the radial direction or are mounted pivotably. They are controlled via cam discs, cams, etc.

Furthermore, assigned to the folding turret is a number of fixed folding members which, during the conveying movement of the folding turret, make folds in the blanks on the radially outer side (outer face) and on a free end face of the hollow mandrel.

Where the inner blank (tinfoil mandrel) is concerned, these are initially folding members which make the radially outer tubular fold (tubular overlap) of the mandrel. Furthermore, folding members used make a bottom fold of the tinfoil blank in the region of the free end face (envelope fold).

In addition, members for fixing and stabilising the folds are assigned to the folding turret after the folding members.

Following the folds for the tinfoil and paper blanks, the cigarette groups are fed to the hollow mandrels over a part periphery of the folding turret, in particular are pushed into and through the latter in the longitudinal direction of these, the cigarette groups passing out of the hollow mandrels, whilst at the same time taking up the largely ready-folded blanks (cup pack).

The cigarette groups are preferably conveyed by an endless pocket chain, especially of the design according to German Patent Application P No. 35 27 741.6, which revolves continuously at least in the region of the folding turret and at the same speed as this. Along a part periphery of the folding turret, the pocket chain rests against this in such a way that pockets of the pocket chain are in line with the hollow mandrels, so that by means of slide members movable in the longitudinal direction of the hollow mandrels, the cigarette groups can be pushed out of the pockets, into the hollow mandrels and through the latter.

An exemplary embodiment of the apparatus, in particular of the folding turret with associated units, is explained in detail below with reference to the drawings:

DETAILED DESCRIPTION OF A PREFERRED EMBODIMENT

The relevant part of a complete packaging machine consists essentially of a folding turret 20 with associated units. The folding turret 20 is driven to revolve continuously. During one revolution, soft-cup packs for receiving cigarette groups are produced and filled. Packs of the above-mentioned type consist of an inner wrapping, especially a tinfoil blank 21, and an outer wrapping, namely a paper blank 22.

Figure 2:
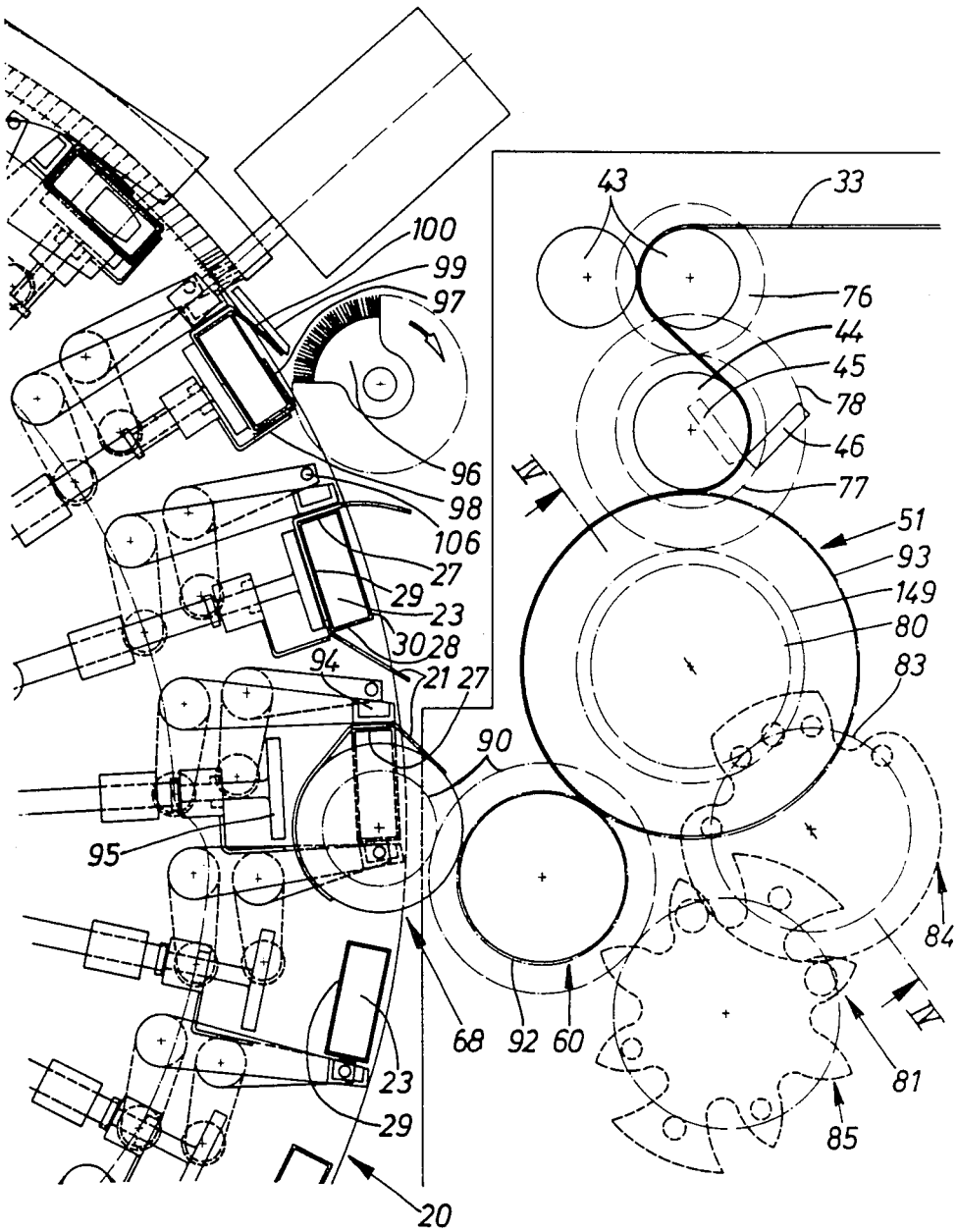
FIG. 2 shows a side view, on an enlarged scale, of a (first) blank-unit with a portion cut out from the folding turret.
Figure 6:
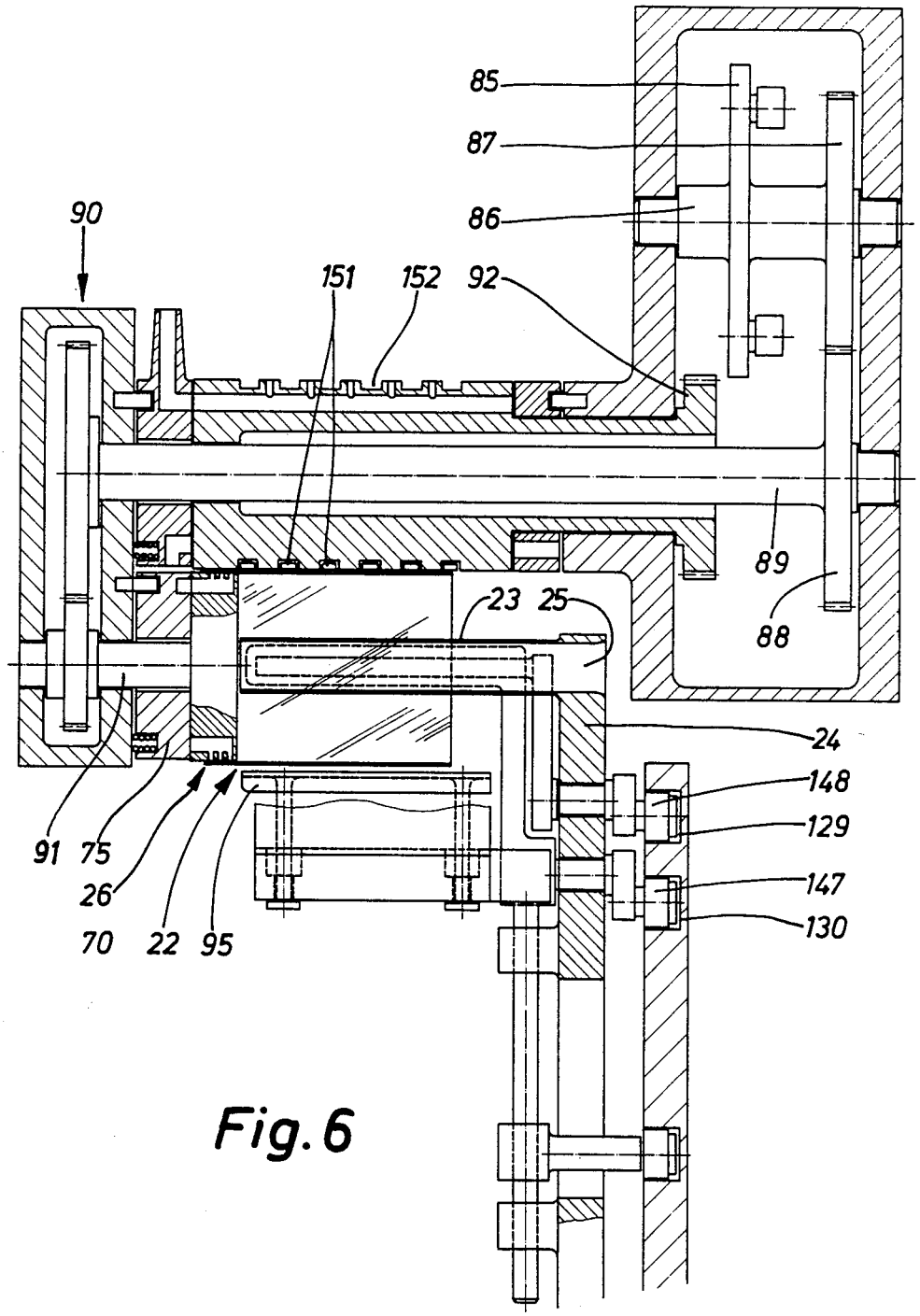
FIG. 6 shows a longitudinal section through a blank-conveyor of the second feed unit (acceleration conveyor)

In order to receive the above-mentioned blanks 21, 22, make folds and introduce the cigarette groups, the folding turret 20 is equipped, adjacent to the outer edge, with blank-receptacles in the form of hollow mandrels 23. These are hollow bodies of rectangular cross-section which are open at their ends. The hollow mandrels are fastened to a turret disc 24 so as to protrude or project on one side. The latter is provided, in the region of each of the hollow mandrels 23, with an aligned passage orifice 25 (FIG. 6). The axial dimension of the hollow mandrel 23 is such that the blanks 21 and 22 can be received on the hollow mandrel 23, at the same time forming projecting lengths at the free end. The projecting lengths are so many folding tabs 26 which are folded against the free open end of the hollow mandrel 23 to form a bottom wall of the tinfoil blank 21 or of the paper blank 22. The hollow mandrels 23 are attached to the turret disc 24 in such a way that narrow side faces, in particular the front side face 27 and the rear side face 28, are directed respectively to the front and to the rear in the peripheral direction (FIG. 2). These are assigned to the narrow side walls of the pack. A larger inner face 29 and a corresponding outer face 30 are directed radially inwards and outwards respectively. The former serves to allow front walls of the blanks or of the pack to rest against it, whilst rear walls rest against the outer face 30.

Figure 1:
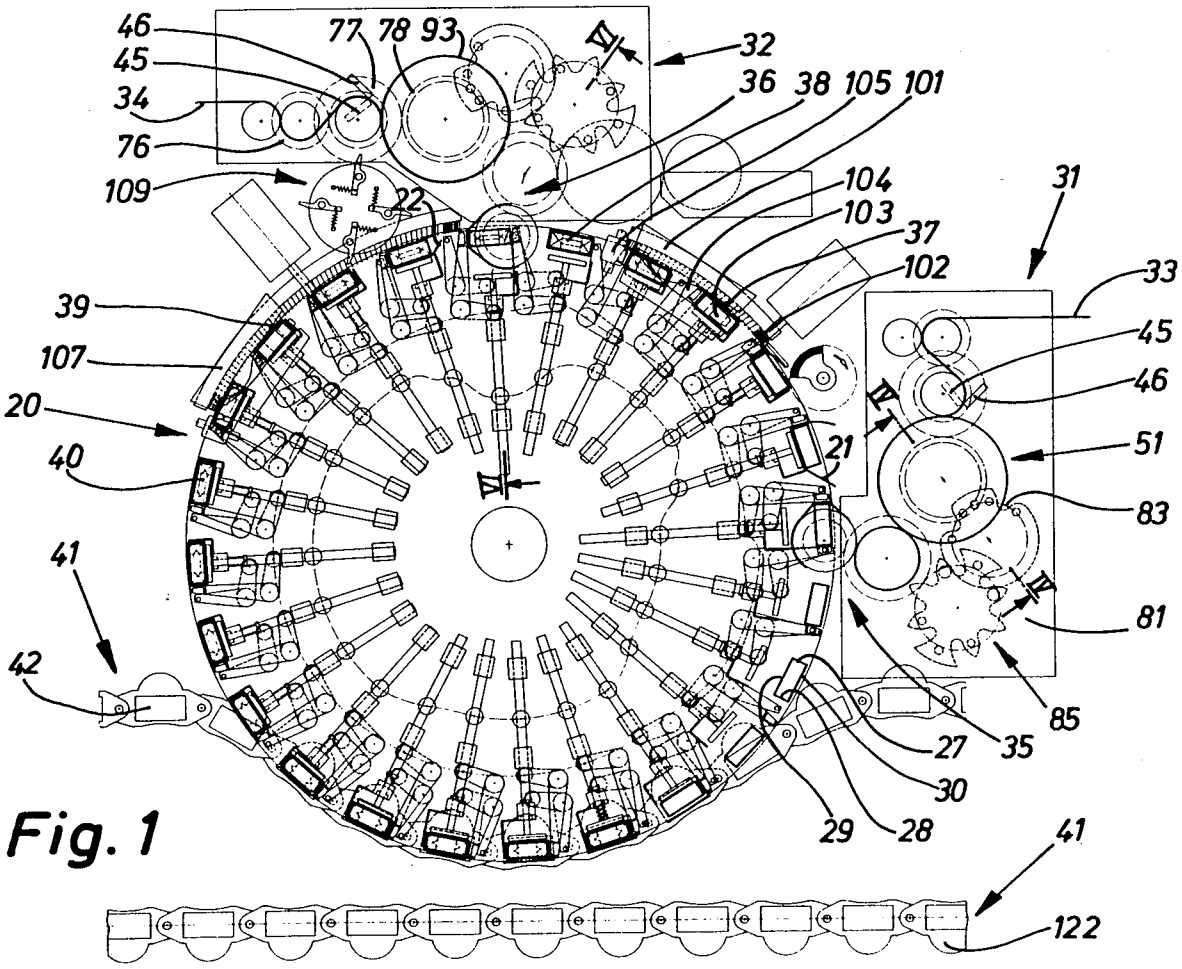
FIG. 1 shows a side view of the apparatus, in particular the folding turret with the associated units.

Blank-units 31 and 32 (FIg. 1) are assigned to the folding turret 20 for producing the tinfoil blanks 21 and the paper blanks 22 and for transferring these to the hollow mandrels 23 of the folding turret 20. The blanks are severed from a continuous tinfoil sheet 3 and paper sheet 34. The blank-units 31 and 32 are each arranged fixedly on the periphery of the folding turret 20 in the region of a first transfer station 35 and a second transfer station 36 for the blanks 21, 22. During the transport of the tinfoil blank 21 from the transfer station 35 to the transfer station 36 (blank-unit 32), the necessary folds are made on the tinfoil blank 21, in particular a tubular overlap 37 on the outer face 30 of the hollow mandrel 23 and a bottom wall 38 by means of trapezoidal folding of the folding tabs 26.

At the transfer station 36, the paper blank 22 is then laid onto the hollow mandrel 23 or onto the already folded tinfoil blank 21 on the hollow mandrel.

After the transfer station 36, the paper blank 22 is then folded, likewise to form a tubular overlap 39, but in the region of the side face 28 located at the rear in the conveying direction. Furthermore, the projecting folding tabs 26 are folded round to form a bottom wall 40 by means of fixed folding members mounted outside the range of rotation of the folding turret 20.

The first transfer station 35 is located at the side of the folding turret 20, revolving in a vertical plane, approximately in the horizontal mid-plane. The transfer station 36, shifted the amount of a quarter circle, is formed approximately in the vertical mid-plane. The transfer station 36, shifted the amount of a quarter circle, is formed approximately in the vertical mid-plane. Opposite this, that is to say in the region of a lower part circle, a pocket chain 41 (FIG. 1) comes up to the periphery of the folding turret 20. This is designed with individual pockets 42, in each of which a cigarette group (contents of a pack) is accommodated. The pocket chain 41 driven continuously or synchronously in the region of the folding turret 20 is picked up by the folding turret 20 in such a way that, during the synchronous movement, a number of pockets 42 is aligned with associated hollow mandrels 23, so that the cigarette groups can be transferred to the hollow mandrels 23 and finally to the blanks 21, 22 folded on top of one another.

The transfer of the blanks 21, 22 to the folding turret 20 is of particular importance.

Figure 3:
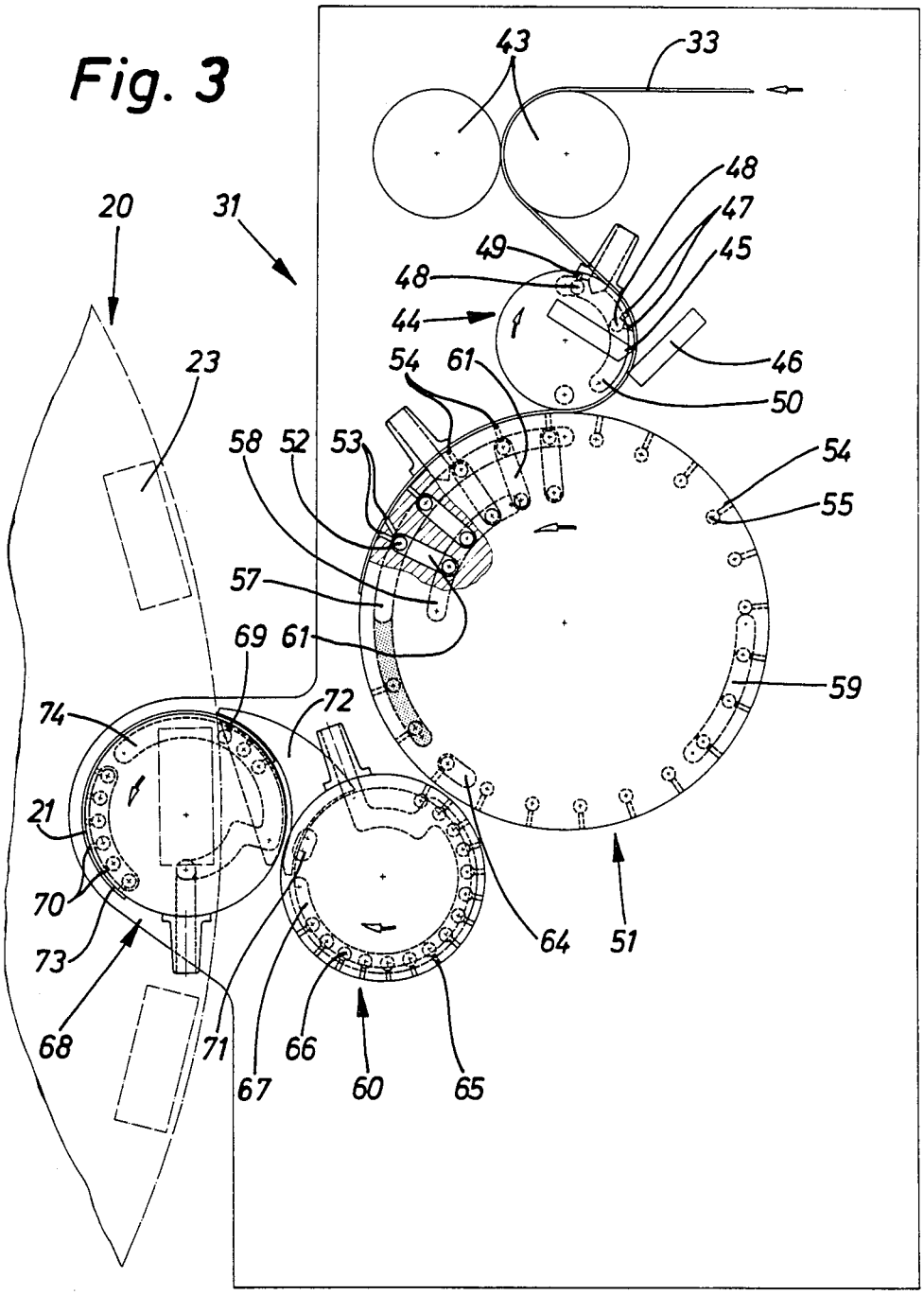
FIG. 3 shows the detail according to FIG. 2 with blank-conveyors represented differently.

At the blank-unit 31 for the tinfoil blanks 21, the tinfoil sheet 33 is fed at a specific speed to a knife roller 44 via a pair of draw rollers 43 (FIGS. 2 and 3). The knife roller 44 is equipped, in a way known per se, with a knife 45 which projects beyond the peripheral surface of the knife roller 44 and which interacts with the cutting edge of a fixed counter-knife 46. The knife roller 44 is provided with suction bores opening onto the peripheral surface in order to fix the tinfoil sheet 33. Two groups of suction bores 47 with a connected axis-parallel suction channel 48 are arranged adjacent to the revolving knife 45. The double row (in the longitudinal direction of the roller) of the suction bores 47 in conjunction with the suction channel 48 ensures a particularly effective fixing of the region of the tinfoil sheet located at the front in the direction of transport, after a blank has been severed. At a distance from the suction bores 47, there is a single row of suction bores 49 exerting a lower holding force. The suction bores 47, 49 or the suction channel 48 connecting these to one another communicate in the usual way with a fixed suction segment 50. Suction air is transmitted to the suction bores as long as the suction channel 48 is located in the region of the suction segment 50.

The tinfoil sheet 33, before a tinfoil blank 21 is severed from it, is transferred to a further blankconveyor, in particular to an acceleration roller 51 (FIG. 1–4. This is likewise provided along the periphery with suction bores arranged in a systematic distribution. For grasping the respective front part of the tinfoil sheet 33, two rows of suction bores 53 are assigned to a (axisparallel) suction channel 52. There then follows a number of individual rows of suction bores 54 arranged at equal distances from one another and each with a suction channel 55. As is evident from FIG. 4, the suction bores and the suction channels 52, 55 are connected pneumatically to a fixed control disc 56. On the side facing the suction channels 52, 55, the control disc is equipped with suction segments 57, 58 and 59 in the form of an arc of a circle. These are arranged concentrically relative to the control disc 56 or to the acceleration roller 51. When the ends or mouths of the suction channels 52, 55 are covered by the suction segments 57, 59, suction air is applied to the suction bores 53, 55 via a central vacuum line (not shown).

On the acceleration roller 51, the (main) suction segment 57 extends from the region of reception of the tinfoil sheet 33 by the knife roller 44 along the conveying zone and virtually up to an intermediate conveyor roller 60 which receives the tinfoil blank 21 from the acceleration roller 51. In a region following the reception of the tinfoil sheet 33 by the knife roller 44, an increased suction force is exerted on the tinfoil sheet 33 or on the now severed tinfoil blank 21. This secures the tinfoil blank 21, after if has been severed, on the outer surface of the acceleration roller 51 even at a higher conveying speed as a result of the higher peripheral speed of the acceleration roller 51 in relation to the knife roller 44. Before the tinfoil blank 21 is severed, the region of the tinfoil sheet 33 received by the acceleration roller 51 is held back under a slipping effect. After the tinfoil blank 21 has been severed, it moves away from the tinfoil sheet 33 at the distinctly higher peripheral speed.

To increase the holding or suction force, the second suction segment 58 is arranged concentrically relative to the suction segment 57 in the necessary region. The shorter suction segment 58 is connected to the suction segment 57 via radial suction grooves 61. These are formed in an end face or front face of the acceleration roller 51 directed towards the control disc 56, that is to say are assigned to a specific selected group of suction bores 52 or 55 in order to fix the front part of the tinfoil sheet 33.

The suction air for the suction segments 57, 58 and 59 is supplied via the control disc 56. In order to generate a sufficient vacuum, this is equipped with an annular vacuum chamber 62 of relatively large size. The cavity acts as an "air tank", that is to say it has an accumulator and buffer effect. The vacuum chamber 62 is connected on the one hand to a vacuum source via a nozzle 63 and on the other hand directly to the suction segments 58 and 59.

When the region of the tinfoil blank 21 located at the front in the direction of transport, after it has been severed from the tinfoil sheet 33, enters the region of transfer from the acceleration roller 51 to the intermediate conveyor roller 60, the vacuum should be reduced. For this purpose, in this region (marked by a dotted area) the suction segment 57 has a smaller axial depth than in the preceding region. Whereas, for example, the suction segment 57 has a depth (in the axial direction) of 6 mm in the region of the higher suction force, the region facing the intermediate conveyor roller 60 has a depth of only 1 mm.

Directly in the region of transfer of the tinfoil blank 21 to the intermediate conveyor roller 60, a short air relief segment 64 is formed in the control disc 56 concentrically or in the annular path of the suction segment 57, in order, by reducing the vacuum, to transfer the tinfoil blank 21 reliably to the intermediate conveyor roller 60 likewise equipped with suction bores 65.

The suction bores 65 of the intermediate conveyor roller 60 are distributed over a larger peripheral region and are connected in rows to axis-parallel suction channels 66. These communicate temporarily in the way already described with an annular suction segment fo a fixed control disc, so that suction air takes effect at the suction bores 65 in order to hold the tinfoil blank 21.

Figure 7:
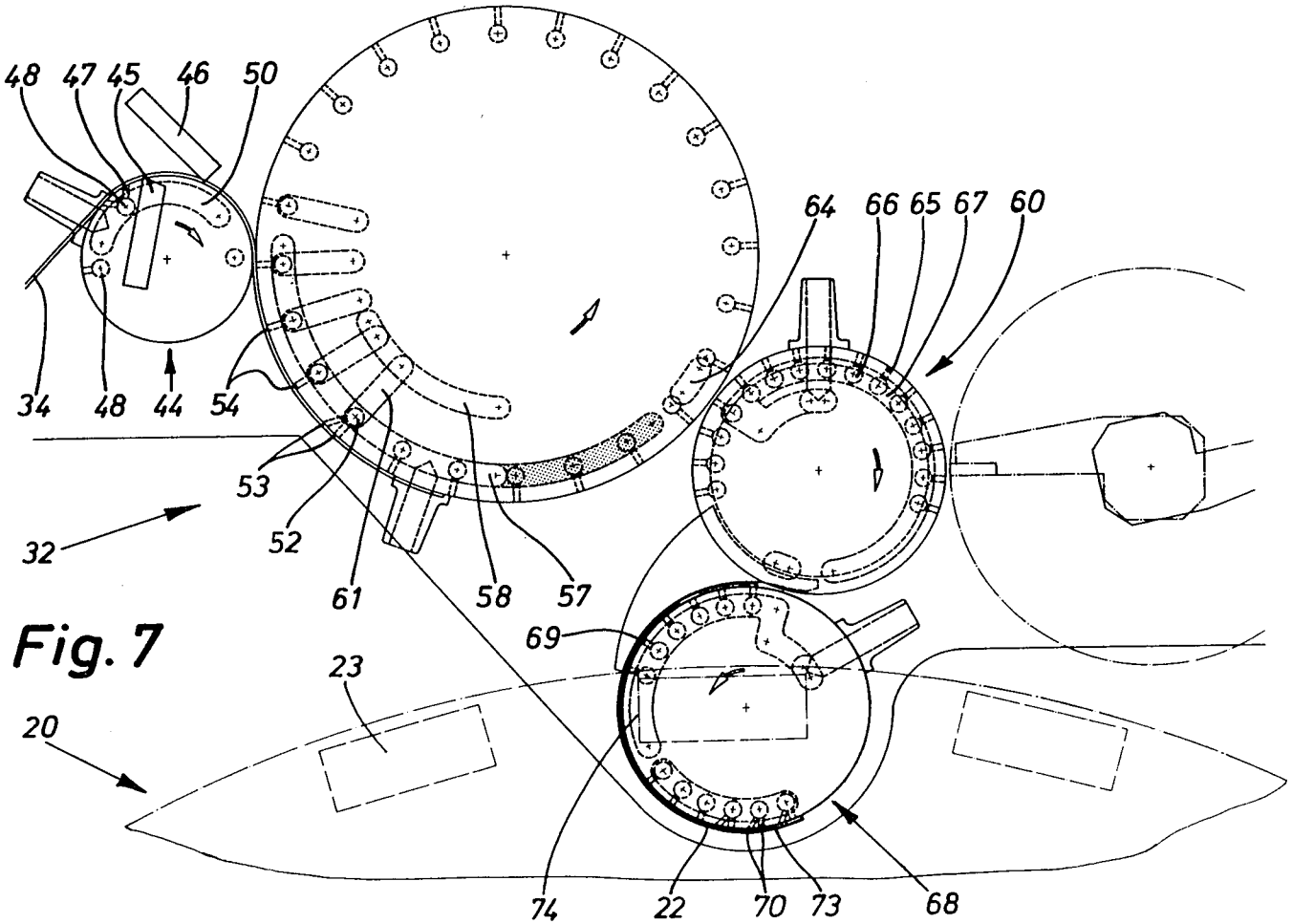
FIG. 7 shows details of the blank-unit according to FIG. 6 in a different representation.

Adjacent to the periphery of the intermediate conveyor roller 60 is a blank-holer, the function of which is to bring the tinfoil blank 21 into position and hold it for reception by a hollow mandrel 23 of the folding turret 20. The blank-holder, designed as a circular holding disc 68, is equipped with two groups of suction bores 69 and 70 which take effect at a distance from one another on the peripheral surface of the holding disc 68 (FIGS. 3, 6 and 7). The arrangement is such that the group with the larger number of suction bores 70 takes effect when the blank (tinfoil blank 21) is received from the intermediate conveyor roller 60, whilst the group with the suction bores 69 grasps a part of the blank located at the rear in the conveying direction. The intermediate conveyor roller 60 or its control disc is equipped, in the region of transfer, with an air relief segment 71 of known function.

To guarantee the transfer of the blank (tinfoil blank 21) from the intermediate conveyor roller 60 to the holding disc 68, a wedge-shaped lead piece 72 (FIG. 3) is fixed in place in this region. By means of a guide surface, this lead piece 72 surrounds part of the periphery of the holding disc, in such a way that the blank coming loose from the peripheral surface of the intermediate conveyor roller 60 is guided up to the periphery of the holding disc 68. To ensure that the blanks are transferred faultlessly to the holding disc 68, the lead piece 72 is equipped with fingers 151 (FIG. 6) which extend at a distance from one another and which fit into annular grooves 152 in the outer surface of the intermediate conveyor roller 60. The annular grooves 152 are arranged in the region between respective suction bores 65.

The holding disc 68 is a principal item of the blank-unit 31. It is arranged so that the blank is offered in the path of movement (orbit) of the hollow mandrels 23. The holding disc 68 driven to rotate intermittently is stationary during the moment when a blank is received by a hollow mandrel 23. The holding disc 68 or its axis of rotation is arranged centrally relative to the hollow mandrels 23 or to their path of movement.

A further special feature is that the holding disc 68 is mounted offset laterally in the axial direction in relation to the preceding blank-conveyors and in relation to the folding turret 20 and its hollow mandrels 23. As is particularly evident from FIG. 6, the mandrels 23 can run past the holding disc 68 laterally.

In accordance with the offset arrangement of the holding disc 68, the blank (tinfoil blank 21) is fixed to the peripheral surface of the holding disc 68 in the region of a side strip 73 only. The side strip 73 corresponds to the projecting length of the blank for forming the folding tabs 26, from which the bottom wall 38 is folded at a later stage. The suction bores 69 and 70 are arranged in such a way that they grasp and hold the entire blank in the region of the side strip 73 (FIGS. 3, 6 and 7). The predominant region, namely that for forming side walls, the front and rear walls and an upper end wall of the inner wrapping (tinfoil blank), extends outside the region of the holding disc 68, so as to project laterally from this, but in the path of movement of the hollow mandrels 23 (FIG. 6).

The dimensions of the holding disc 68 are such that the blank or its side strip 73 covers only part of the periphery. The blank 21 thus forms a hollow body in the form of a part cylinder, which is open in a rear region, as seen in relation to the direction of rotation of the folding turret 20. From here, the hollow mandrel 23 enters the hollow body formed by the blank and grasps it on the inside at a point predetermined by the relative position of the blank on or against the holding disc 68. As a result of the further movement of the hollow mandrel 23, the blank 21 is taken up and drawn off from the outer surface of the holding disc 68. In this position, the two groups of suction bores, 69 on the one hand and 70 on the other hand, are located on different sides of the path of movement of the hollow mandrels 23. The blank 21 is thereby fixed (initially) to the holding disc 68 on both sides of the hollow mandrel 23. When the blank 21 is lifted off, the suction bores 69 and 70 are consequently exposed. The vacuum breaks down, and the blank 21 can therefore be taken up easily.

In the present exemplary embodiment, the blank 21 is positioned on the holding disc 68 so as to be offset in the peripheral direction. The blank legs forming on both sides of the hollow mandrel 23 when the blank is drawn off from the holding disc 68 are of unequal length (FIG. 2). The suction bores 69 and 70 (FIGS. 3, 6 and 7) are arranged and designed in keeping with this. When the blank 21 is received by the hollow mandrel 23, the smaller number of suction bores 69 is immediately adjacent to the path of movement of the hollow mandrel in the region of the shorter blank leg. During this phase, the suction bores 69 are also located in the region of a suction segment 74 which is formed in the way already described inside a fixed control disc 75 (FIGS. 3, 6 and 7). The group of suction bores 70, which, when the blank 21 is received from the intermediate conveyor roller 60, grasps the front region of the blank and carries it along, is located outside the region of the suction segment 74 at the time of transfer to the hollow mandrel 23. However, since, in this position, the suction bores 70 are not relieved of air, the blank 21 is held with sufficient force. At the moment when the blank 21 is lifted off from the holding disc 68, the vacuum also breaks down in the region of the suction bores 70.

The blank-conveyors of the blank-unit 31 (and of the blank-unit 32 of the same design) are driven from the pair of draw rollers 43 driven at a uniform speed. The knife roller 44 and the acceleration roller 51 are likewise driven in a continuous rotary movement via a drive gear wheel 76 and intermediate wheels 77, 78 and (FIGS. 1, 2, 4 and 5). The drive transmission is selected so that the acceleration roller 51 rotates at a markedly higher speed than the preceding conveyors.

The intermediate wheel 149 assigned to the acceleration roller 51 is mounted on an intermediate shaft 79 which on the one hand transmits the drive of the acceleration roller 51 and on the other hand is connected to a stepping mechanism 81 by means of a gear wheel 80, specifically via a transmission gear wheel 83 mounted on a transmission shaft 82.

The stepping mechanism 81 is designed in a way known per se, that is to say with a driving wheel 84 and a star wheel 85. A stepping movement, that is to say one with a stationary phase, is produced as a result of the design of these transmission parts.

Figure 4:
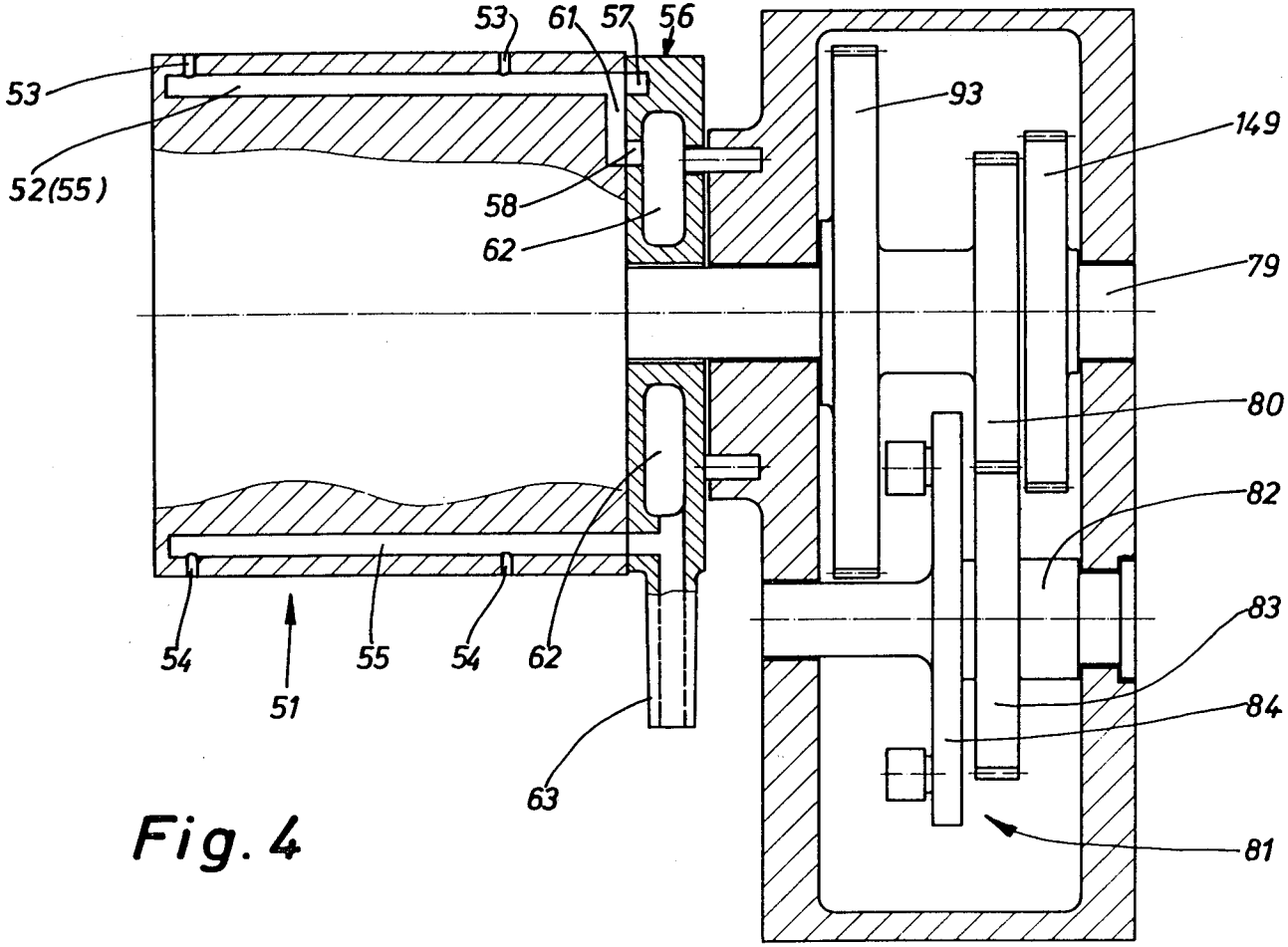
FIG. 4 shows details of the blank-unit according to FIG. 2 and 3, in section, on a further-enlarged scale.
Figure 5:
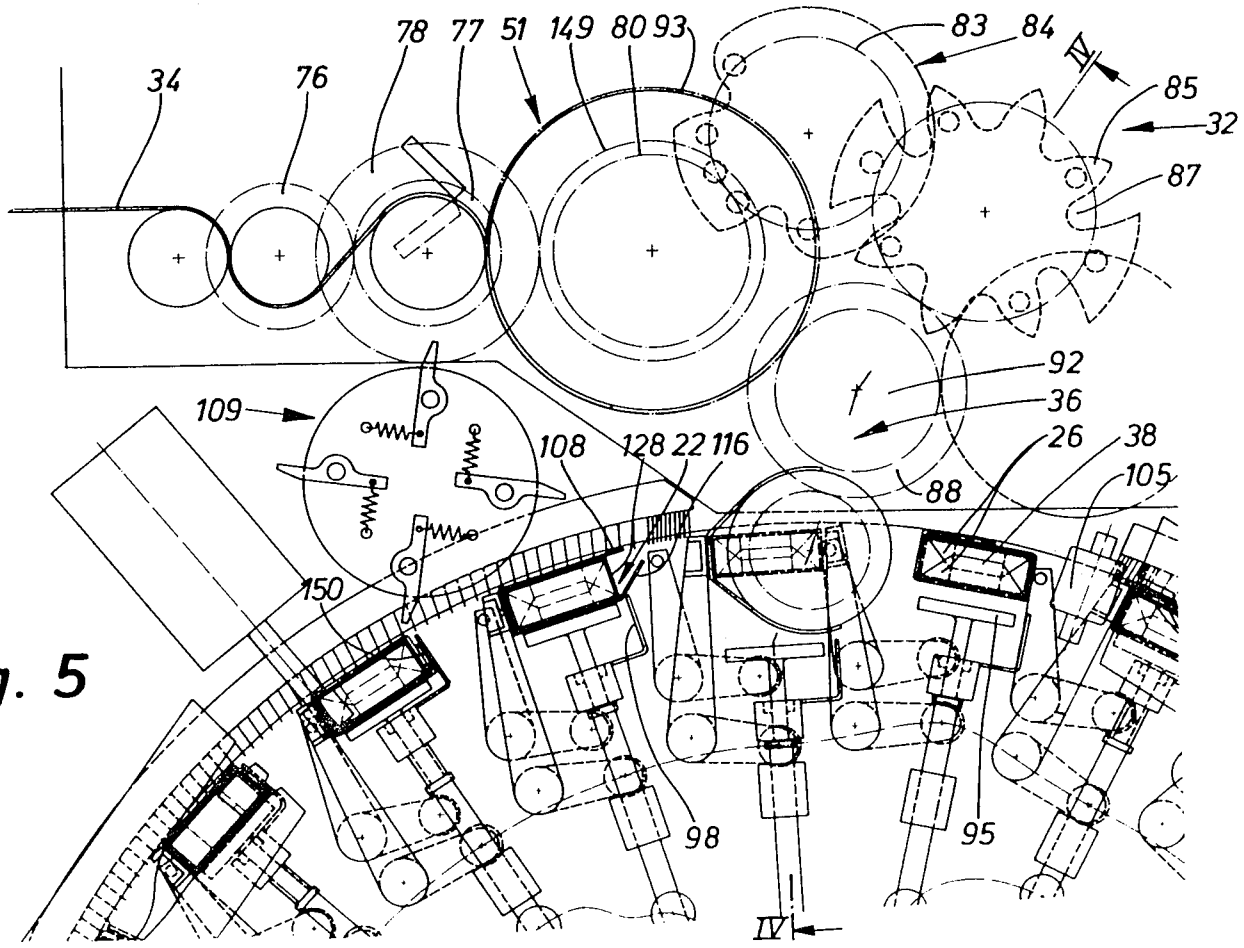
FIG. 5 shows a diagrammatic side view of a (second) unit for the paper blank.

The star wheel 85 is mounted on a star-wheel shaft 86 connected via gear wheels 87, 88 to a main shaft 89 (FIGS. 4 and 6). This is mounted rotatably in the intermediate conveyor roller 60 designed as a hollow body or is guided through this. Outside the region of the intermediate conveyor roller 60, the (stepping) drive of the main shaft 89 is transmitted, via an intermediate gear 90, to the holding disc 68 by means of its drive shaft 91. Accordingly, the intermediate conveyor roller 60 can be driven continuously relative to the main shaft 89 and independently of the latter via a gear wheel 92 which is engaged with a further gear wheel 93 on the intermediate shaft 79 of the acceleration roller 51 (FIG. 4).

Figure 12:
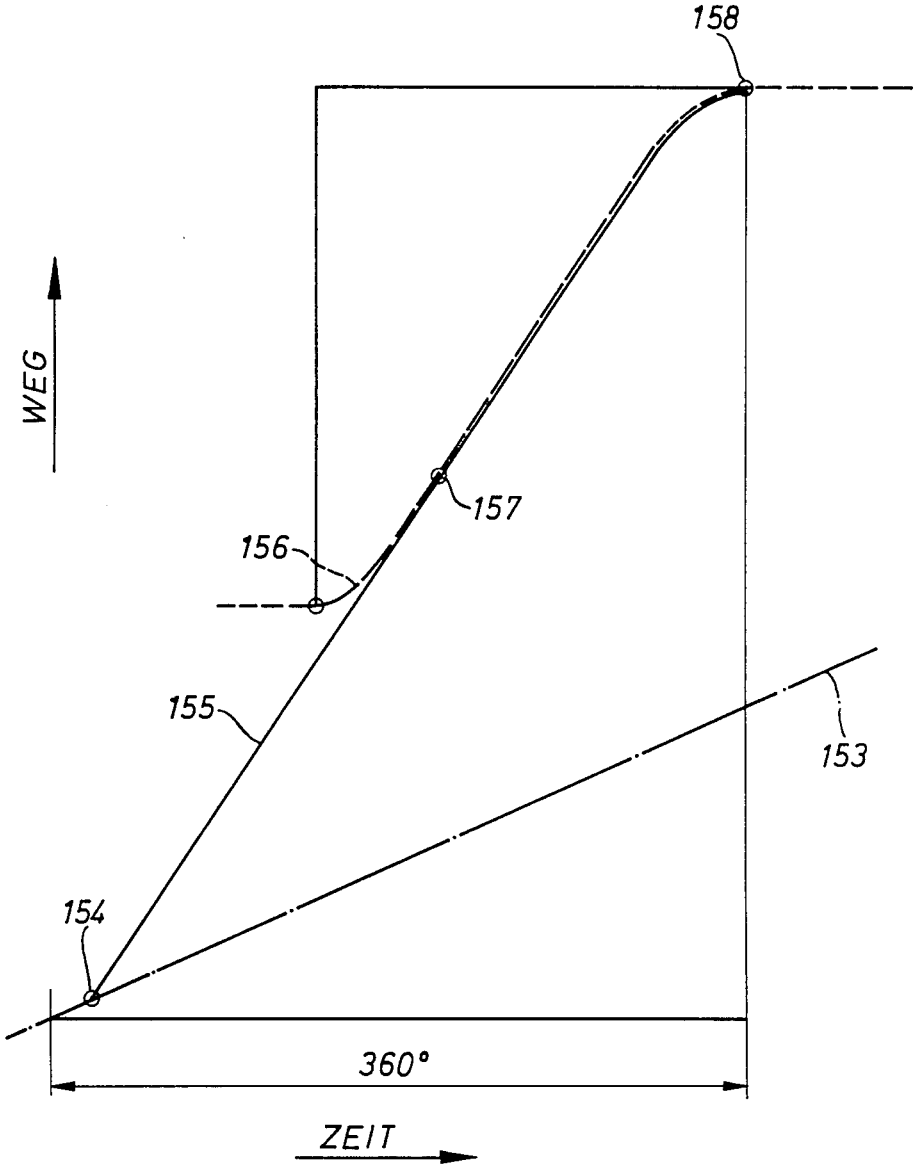
FIG. 12 shows an operating diagram.

The cycle of movement of the blank-conveyors on the one hand and of the blanks on the other hand is represented diagrammatically in the time/travel diagram according to FIG. 12. The straight line 153 symbolises the feed speed $V_1$ of the tinfoil sheet 33 (or paper sheet 34). From a point of intersection 154 onwards, the tinfoil blank severed from the tinfoil sheet 33 is conveyed at a higher speed $V_2$ represented by the straight line 155. The movement of the holding disc 68 is represented by the broken line 156. The holding disc 68 is accelerated from standstill to the speed of the blank 21, until the same feed speed is obtained over a particular distance, as represented by the overlap of the straight line 155 with the line 156. A point marking 157 represents the moment when the blank is received by the holding disc 68. The blank and the holding disc then move to a standstill in the region of a standstill point 158. At this moment, the blank 21 is grasped by a hollow mandrel 23 on the rear side.

The (tinfoil) blank 21 received by the side face 27 of the hollow mandrel 23 located at the front in the direction of movement is fixed to this side face 27 without delay, specifically by means of a first pressing device 94. After the blank 21 has left the region of the holding disc 68, a further retaining member for the blank 21 is used, namely a pressing plate 95 which is movable in the radial direction and which presses part of the blank against the inner face 29 of the hollow mandrel 23. The above-mentioned holding members are assigned to each hollow mandrel 23 and revolve together with folding turret 20.

In this position, the (tinfoil) blank 21 is fed to a first folding station. By means of a folding brush 96 fixed in place and driven to rotate, a rear or inner tubular tab 97 is folded against the outer face 30 of the hollow mandrel 23. At the same time or immediately beforehand, a lateral folding leg 98 is moved radially outwards. As a result, a region of the (tinfoil) blank 21 is pressed against the rear side face 28 of the hollow mandrel. In the course of further movement, the hollow mandrel enters the region of a fixed run-in guide 99 which, as a result of the relative movement, folds an outer tubular tab 100 of the blank 21 likewise against the outer face 30 or against the tubular tab 97.

The hollow mandrels 23 together with the (tinfoil) blanks folded to this extent pass to the region of a pressing brush 101 which is in the form of a segment of an arc of a circle and which fixes the above-described fold during the further movement.

At the same time, in this region, the folding tabs 26 for forming the bottom wall 38 are folded by folding members set in place or fixed and acting laterally next to the folding turret 20, in particular a rotating side folder 102, a fixed folding finger 103 and likewise fixed folding deflectors 104. A rotary brush 105 following the region of the pressing brush 101 is fixed next to the folding turret 20 and smooths the fold of the bottom wall 38.

The hollow mandrels 23 together with the folded tinfoil blank 21 now enter the region of the transfer station 36 for the paper blank 22. Beforehand, the pressing device 94 comes away from its position up against the front end face 27. As a result of a movement directed inwards, the folding leg 98 is retracted from the holding position against the end face 28. Instead of this, a second pressing device 106 comes up against the end face 28.

By means of its now free front end face 27 covered by the tinfoil blank 21, at the transfer station 36 the hollow mandrel 23 can receive the paper blank 22, in particular can draw it off from the holding disc 68 of the blank-unit 32. The paper blank 22 is received in the same way as described with reference to the blank-unit 31 and the tinfoil blank 21. Accordingly, the blank-unit 32 has the same design as the blank-unit 31. The only difference is that the paper blank 22 is fixed approximately centrally on the holding disc 68. A slight eccentricity is ensured because of the position of a tubular fold 150 of the paper blank 22 in the region of the rear end face 28.

The folding members which now follow correspond predominantly to those for folding the tinfoil blank 21. Special folding members are provided for forming the tubular fold 150 in the region of the end face 28. The hollow mandrel 23, together with the paper blank 22, first runs into the region of a longer pressing brush 107 in the form of an arc of a circle. A radially outer blank leg is thereby laid against the outer face 30. On the rear side of the hollow mandrel 23, a (somewhat shorter) inner tab 108 projects beyond the hollow mandrel 23. This is folded round against the rear end face 28 by means of a folding unit 109 fixed in place and mounted so as to rotate.

Figure 11:
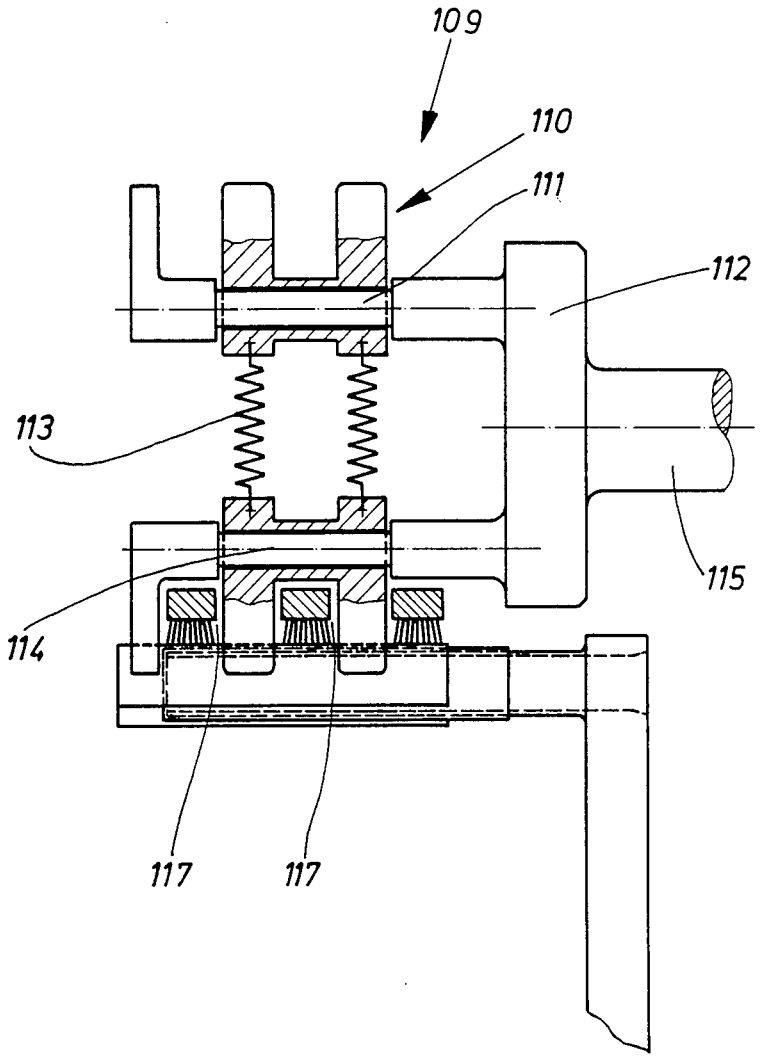
FIG. 11 shows, partially in section, a folding member as a detail on an enlarged scale.

The folding unit 109 consists of several, namely four (double) folding fingers 110 which are arranged pivotably (pivot bearings 111) on a rotating carrier disc 112 at equal peripheral distances from one another. The folding fingers 110 are prestressed into an initial position by tension springs 113. According to the exemplary embodiment of FIG. 11, the actual situation is that the (double) folding fingers 110 are mounted pivotably on a fixed pivot axle 114 and every two folding fingers 110 located diametrically opposite one another are connected to one another by means of the tension springs 113. The entire folding unit 109 is driven by a shaft 115 in such a way that any one of the (double) folding fingers 110 is pointed towards the rear side (end face 28). As a result of the movement of the folding unit 109, the folding finger 110 folds the projecting inner tab 108 against the rear end face 28. Constraints are avoided because of the pivotable elastic mounting of the folding fingers 110.

Immediately after this folding step, the folding leg 98 already described is moved radially outwards from its initial position, thereby taking up and folding round an outer tab 116 which is laid partially over the inner tab 108, so that in this region the tubular fold 150 is fixed as a whole by the folding leg 98. The pressing brush 107 is provided, in the region of the folding unit 109, with slit-like recesses 117 which allow the folding fingers 110 to pass through the pressing brush 107.

The subsequent folding members for forming the bottom wall 40 correspond to the folding members already described, namely a side folder 102, folding finger 103, folding deflector 104 and rotary brush 105.

The pack completed to this extent (with the exception of the upper end wall) is delivered by the hollow mandrel 23 to the region in which the pocket chain 41 runs synchronously with the folding turret 20 (the lower region of the folding turret 20).

Figure 8:
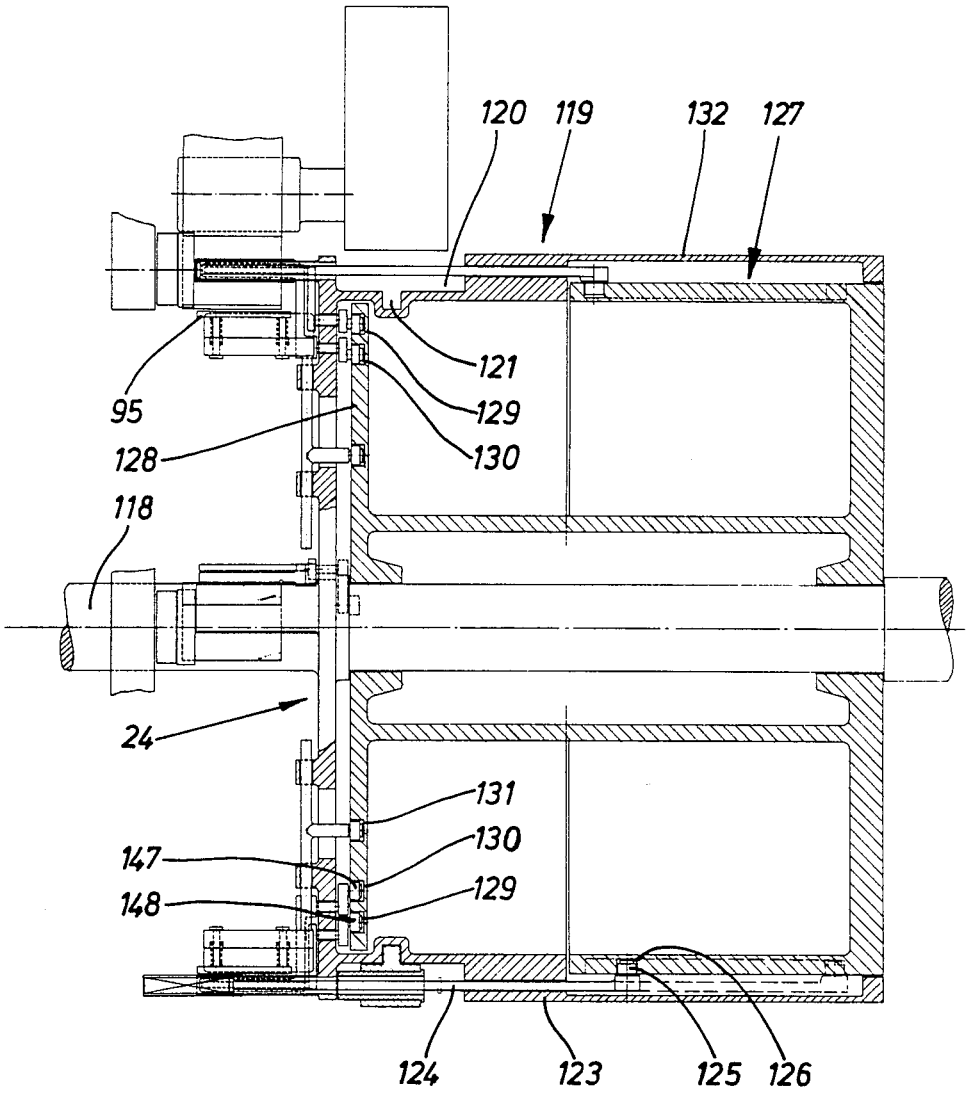
FIG. 8 shows an axial section through the folding turret.
Figure 9:
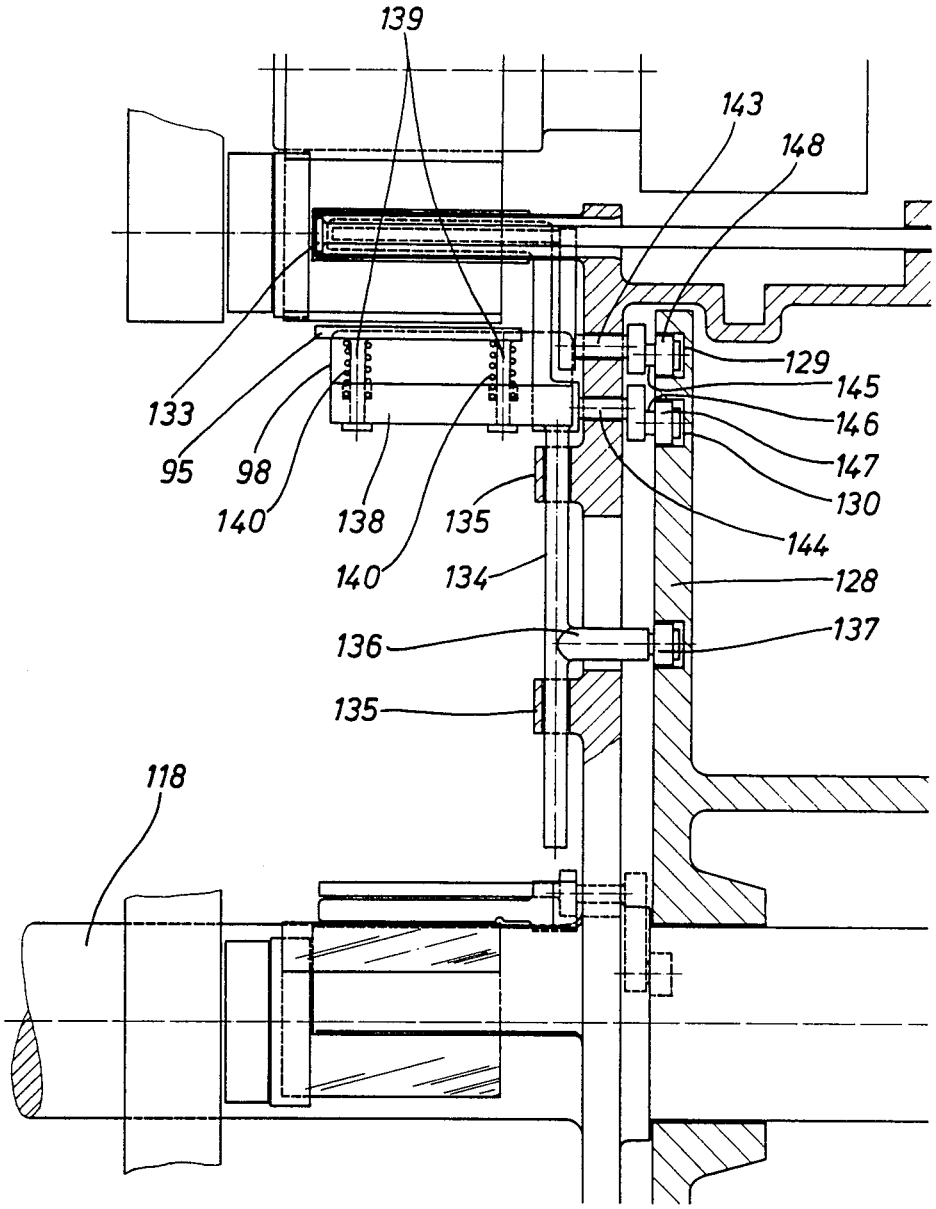
FIG. 9 shows a part region of the end face of the folding turret, likewise in axial section and on an enlarged scale.

Details of the filling of the packs and the pushing off of these from the follow mandrels 23 emerge especially from FIGS. 8 and 9 which also show the overall structure of the folding turret 20.

According to these, the turret disc 24 is mounted firmly on a turret shaft 118. On the rear side located opposite the hollow mandrels 23, an elongate cylindrical supporting part 119 adjoins the turret disc 24, in particular integrally. Directly adjacent to the rear side of the turret disc 24, the supporting part 119 is provided with a depression 120 which extends all round and which has an even deeper guide trough 121. The depression 120 serves for receiving the pocket chain 41 in the particular lower peripheral region of the folding turret 20. At the same time, the guide trough 121 performs an adjusting function. For this purpose, guide troughs arranged in a row and approximately semi-circular, as seen in the side view, are distributed along the periphery in the depression 120. The arrangement and dimensions of these are selected so that a correspondingly semi-circular extension 122 on each pocket 42 of the pocket chain 41 fits positively into one of the guide troughs 121. This "intermeshing" of the pocket chain 41 with the folded turret 20 ensures an exact alignment of the pockets 42 or pocket orifices with the hollow mandrels 23.

The supporting part 119 extends over a relatively long axial region and forms a guide 123 for elongate pushing-out rams 124 assigned to each hollow mandrel 23. Each pushing-out ram 124 is mounted slidably in an axisparallel bore of the guide 123 so as to be displaceable in the longitudinal direction. At the free end, each pushing-out ram 124 is equipped with a laterally directed guide roller 125 which runs in a guide groove 126 in a guide body 127 of the folding turret 20. The guide groove 126 is designed so that, when the turret disc or supporting part 119 revolves, the pushing-out ram 124 can execute a long stroke as a result of the movement of the guide roller 125 in the guide groove 126.

The control body 127 is mounted fixedly. The turret shaft 118 extending through the control body 127 is mounted rotatably in this, and consequently the control body 127 is supported on the turret shaft 118.

Adjacent to the turret disc 24, the control body 127 forms a (fixed) control wall 128. This is provided with several control grooves 129, 130 and 131 extending all round on the side facing the turret disc 24, in order to execute controlled movements of members of the folding turret 20 which have already been mentioned.

The rear part of the control body 127 distant from the control wall 128 is cylindrical and on the outside is covered by the supporting part 119 equipped with a cylindrical extension 132.

Each pushing-out ram 124 can be retracted into an outermost position, in which a ram end plate 133 or the pushing-out ram 124 as a whole is located outside the depression 120 or the path of movement of the pocket chain 41. During the rotation of the folding turret 20, in the lower region, the ram is then moved through the pocket 42 of the pocket chain 41, thereby taking up the cigarette group in the pocket 42. The cigarette group enters the hollow mandrel 23 through the passage orifice 25 in the turret disc 24, directly adjacent to the pocket chain 41. As a result of a further advance, the cigarette group comes up against the bottom wall 38 of the tinfoil blank 21. By means of the cigarette group which moves further, the folded blanks 21 and 22 are now drawn off or pushed off from the hollow mandrel 23, at the same time receiving the cigarette group. The upper end wall of the tinfoil blank 21 still has to be made at a further stage in the cycle.

The pushing-out ram 124 is then retracted into the initial position, so that the pocket chain 41 can run off from the periphery of the folding turret 20. After that, however, the pushing-out ram 124 is once again moved into the pushing-out end position, in which the ram end plate 133 is approximately flush with the free end of the hollow mandrel. The ram end plate 133 now forms a bottom, against which the folding tabs of the bottom walls 38 and 40 can be folded.

The members described further above for holding and folding the blanks 21 and 22 on the hollow mandrels are designed in a special way and are mounted movably on the turret disc 24.

Figure 10:
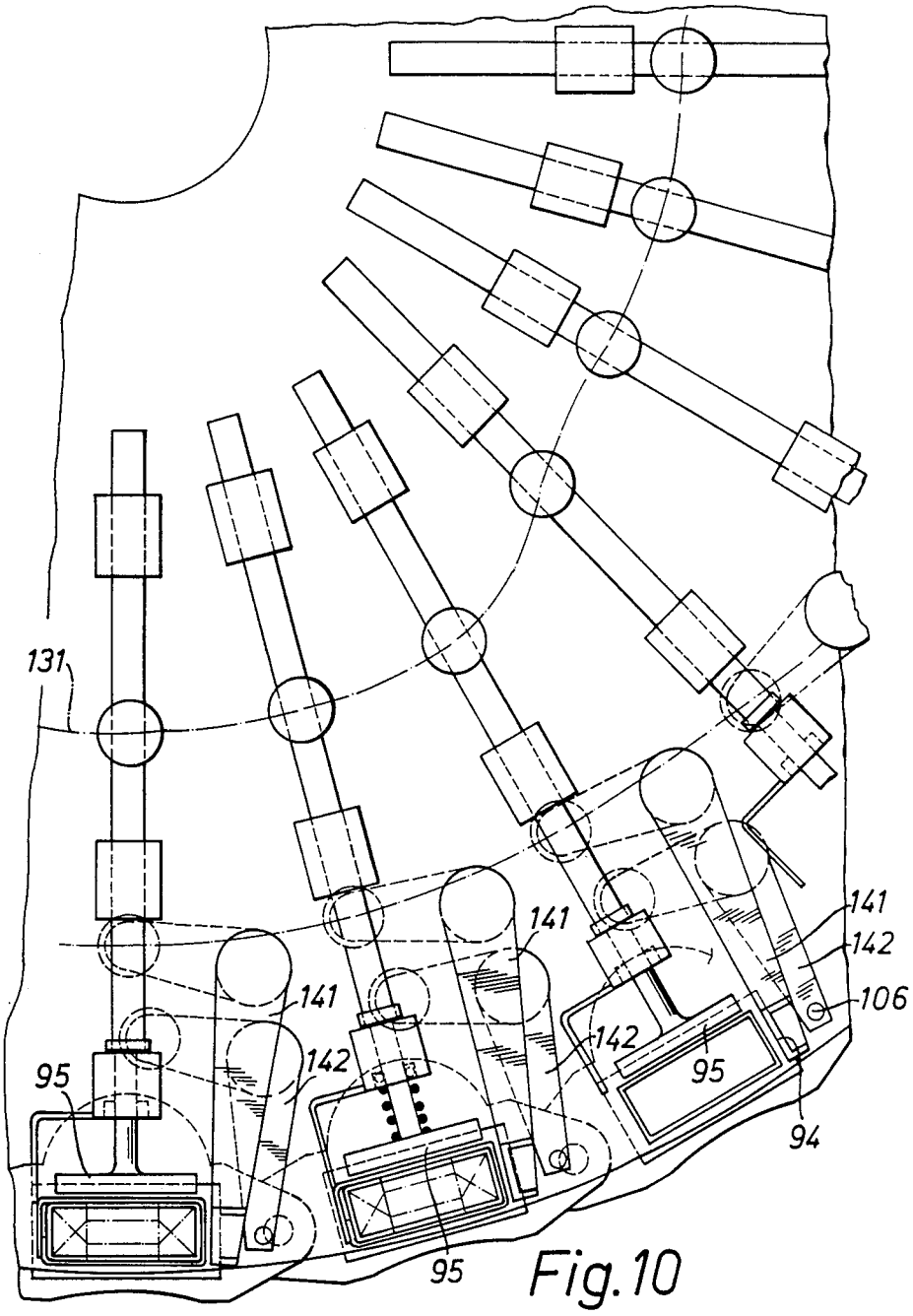
FIG. 10 shows a view on an enlarged scale of a portion cut out from the folding turret.

Assigned to each hollow mandrel 23 is a radially movable supporting ram 134 which is mounted displaceably in two slide guides 135 on the turret disc 24. To actuate the supporting ram 134, in particular to move it radially to and fro, a guide roller 137 is attached to a crossarm 136 and penetrates into the above-mentioned control groove 131 in the control wall 128. The shape of the control groove 131 is represented by dot-and-dash lines in FIG. 1 and 10.

Attached to the upper or radially outer end of the supporting ram 134 are the folding leg 98 on the one hand and the pressing plate 95 on the other hand. The latter is supported elastically on a transversely projecting bracket 138 at the end of the supporting ram 134. For this purpose, the pressing plate 95 is mounted on two holding rams 139 which are arranged at a distance from one another and which are mounted displaceably in the bracket 138. The holding rams 139 are surrounded by supporting springs 140 which bear at one end on the underside of the pressing plate 95 and at the other end on the bracket 138. The pressing plate 195 is thus brought up to the hollow mandrel 23 or the blank 21, 22 with an increasing pressing force. It is ensured, at the same time, that first the blank 21, 22 is grasped by the pressing plate 95 and thereafter the folding leg 98 is activated when the pressing force increases.

The two pressing devices 94 and 106, which are each attached between adjacent hollow mandrels 23, are actuated by pivoting arms 141 and 142, the ends of which are arranged as parts projecting, that is to say, jutting out laterally. The pivoting arms 141, 142 are of differing length and are movable in different planes, so that they can be guided past one another (FIG. 9).

Attached to the radially inner actuating ends of the pivoting arms 141, 142 are actuating pins 143, 144 mounted rotatably in the turret disc 24. These are each connected to a crank mechanism 145, 146. The latter are actuated by guide rollers 147, 148 located in the above-mentioned control grooves 129 and 130. By means of an appropriate design of the control grooves 129, 130 (the dot-and-dash line in FIG. 1), pivoting movements are transmitted to the pivoting arms 141 and 142.

Because of the design of the pressing devices 94 and 106, it is possible for these to assume special relative positions. The pressing device 94 for fixing a blank 21, 22 to the front end face 27 of a hollow mandrel 23 is designed with a large pressing surface, in particular as a U-shaped profile. In contrast, the pressing device 106 is designed as a simple rod which, in specific regions, particularly in the region of the transfer stations 35 and 36, can penetrate the open cavity of the U-shaped profile, so that the two pressing devices 94 and 106 can be folded up in the smallest possible space, specifically on a rear end face 28 of each hollow mandrel, so that as large a gap as possible to the adjacent hollow mandrel is left free for the passage of the blank 21, 22 delivered by the holding disc 68.

We claim:

1. Apparatus for producing soft-cup packs for cigarettes from at least one foldable blank, comprising in a blank transfer station (35, 36):

a continuously rotating folding turret (20, 24) having fixed around its periphery a plurality of hollow receptacles in the form of hollow mandrels (23) each of which is elongated in a direction parallel to the turret's axis of rotation, and each of which has a first end, fixed to said turret (20, 24), and an opposite free end projecting axially away from said turret (20, 24); and a blank feed unit (31, 32) for feeding individual rectangular blanks (21, 22) to successive ones of said hollow mandrels (23) of said continuously rotating turret (20, 24);

said blank feed unit (31, 32) comprising a stationary blank holder in the form of a holding disc (68) for holding a blank for transfer to the free end of a passing mandrel (23) of said continuously rotating turret (20, 24);

said holding disc (68) being disposed out of the path of movement of said mandrels (23), and axially adjacent to the free ends of said mandrels (23);

said holding disc (68) having means for gripping only a lateral edge strip of a blank so that the majority of the blank extends axially in a direction toward said rotating turret (20, 24) and into said path of movement so that the blank (21, 22) is engaged by, and transferred to, a passing mandrel (23);

said holding disc (68) having a peripheral surface on which said blank is held by said gripping means, and which has a circumference greater than the blank's length in the circumferential direction of the disc, so that the blank is held, on only a portion of said peripheral surface of the holding disc, in the form of a stable curved partial cylinder having in said majority portion thereof a gap located to receive an on-coming mandrel (23).

2. Apparatus according to claim 1 wherein said blank feed unit (31, 32) further comprises a fixed guide means (72) for guiding each individual blank (21, 22) onto said peripheral surface of said holding disc (68), said guide means (72) having a circularly curved surface adjacent to, and matching a portion of, said peripheral surface of said holding disc (68), so that each individual blank passes between said curved surface and said peripheral surface.

3. Apparatus according to claim 2, characterised in that endless conveyors, in the form of axis-parallel conveyor rollers with suction bores, continuously feed the blanks (21, 22) to the blank-holder (68).

4. Apparatus according to claim 3, characterised in that there is provided acceleration roller means (51) for accelerating the blanks (21, 22) after they are severed from a continuously conveyed sheet of material (33), (34), and in the region of said acceleration roller means (51) the sheet of material being held back by a slipping effect until the blanks are severed from the sheet of material (33, 34).

5. Apparatus according to claim 4, characterised in that, in the region of the acceleration roller means (51), there is provided means for exerting increased suction forces on the blanks (21, 22) after they have been severed from the sheet of material (33, 34).

6. Apparatus according to claim 3, characterised in that, said fixed guide means (72) is arranged in the region of the feed transfer between said holding disc (68) and an intermediate conveyor roller (60) preceding the holding disc (68) in the blank-feeding direction, and has lead fingers (151) penetrating into peripheral grooves (152) in the intermediate conveyor roller (60), whereby said guide means (72), because of its shape in the form of a circular curve, transfers the blanks (21, 22) onto the peripheral surface of the holding disc (68).

7. Apparatus according to claim 6, characterised in that the endless conveyors for the sheet of material (33, 34), the blanks (21, 22) and the holding disc (68) are movable by means of a common transmission, a stepping mechanism (81) being assigned to the holding disc (68) and the intermediate conveyor roller (60) being designed as a hollow roller for the passage of a main shaft (89) for transmitting the stepping movements to the holding disc (68).

8. Apparatus according to claim 1, characterised in that the blank-holder is an intermittently driven holding disc (68), to the peripheral surface of which the blank (21, 22) is fixed at said lateral edge strip, by suction air.

9. Apparatus according to claim 8, characterised in that the holding disc (68) is equipped with at least two groups of suction bores (69. 70) arranged at a peripheral distance from one another, and a first group of suction bores (70) takes effect in a blank-receiving region and is cut off from a vacuum source after the complete reception of the blank (21, 22) by the holding disc (68).

10. Apparatus according to claim 9, characterised in that, during a stationary phase of the holding disc (68), the two groups of suction bores (69, 70) are each located on different sides of the path of movement of the hollow mandrels (23).

11. Apparatus according to claim 1, characterised in that said holding disc (68) offers the blank (21, 22) axially offset relative to each hollow mandrel (23), in such a way that a region (26) for forming bottom folding tabs for a bottom wall (38, 40) projects axially beyond the free end of hollow mandrel (23).

12. Apparatus according to claim 11, characterised in that the hollow mandrels (23) are U-shaped, the holding disc (68) is arranged centrally relative to the path of movement of the hollow mandrels (23), and the holding disc (68) grips the blank eccentrically on said peripheral surface in such a way that the blank (21) comes up against each hollow mandrel (23) offset, whereby a tubular overlap (37) of the blank (21) is formed in the region of a outer face (30) of the hollow mandrel (23).

13. Apparatus according to claim 12, characterised in that there is provided means for fixing, immediately after the blank (21, 22) is received by a hollow mandrel (23), the blank in the region of a front narrower side face (27) and subsequently in the region of a wide inner face (29) and said opposite wide outer face (30).

14. Apparatus according to claim 13, characterised in that there are pressing devices (94, 106) which can be advanced alternately towards the front and rear side face (27, 28) of the hollow mandrel (23) in order to fix parts of the blanks (21, 22).

15. Apparatus according to claim 14, characterised in that the pressing devices (94, 106) are actuated on pivoting arms (141, 142) of a crank mechanism (145, 146) assigned to each pressing device (94, 106), each crank mechanism (145, 146) being movable by means of separate control grooves (129, 130) in a control wall (128).

16. Apparatus according to claim 13, characterised in that the pressing member for fixing the blank (21, 22) to the inner face (29) of the hollow mandrel (23) is designed as a pressing plate (95) and can be moved each time by means of a radially movable supporting ram (134).

17. Apparatus according to claim 16, characterised in that a pressing plate (95) is mounted elastically on supporting springs (140) which are supported on holding rams (139) of a laterally projecting, jutting-out console (138) of the holding ram (134).

18. Apparatus according to claim 17, characterised in that, to fix the blank (21, 22) or to fold it in the region of the rear side face (28) of the hollow mandrel (23), a folding leg (98) is assigned to each hollow mandrel (23) so as to be radially movable, and the folding leg (98) is moved by the supporting ram (134), in such a way that first the pressing plate (95) comes up against the hollow mandrel (23) and thereafter the folding leg (98) is movable into the folding position.

19. Apparatus according to claim 16, characterised in that the supporting ram (134) is moved by a laterally mounted guide roller (137) which penetrates into a control groove (131) in the control wall (128).

20. Apparatus according to claim 1, characterised in that, for producing the packs with a tinfoil blank (21) and a paper blank (22), two blank-feeding units (31, 32) are assigned to the folding turret (20) at a peripheral distance from one another of approximately 90°; folding members, for folding the tinfoil blank (21), including a bottom wall (38) of the latter, being arranged between a first blank-feeding unit (31), for feeding the tinfoil blank (21), and a second blank-unit (32), for feeding the paper blank (22), arranged in an upper region of the folding turret (20).

21. Apparatus according to claim 20, characterised in that the blank feeding units (31, 32) are of substantially identical design, and in the region of a blank transfer station (36) of the blank-feeding unit (32) the paper blanks (22) are taken up approximately centrally by the hollow mandrel (23), in such a way that a tubular overlap (39) is formed in the region of a rear side face 928) of the hollow mandrel (23).

22. Apparatus according to claim 21, characterised in that a folding unit serves for folding in an inner tab (108) projecting beyond the hollow mandrel (23) at the rear and belonging to the tubular overlap (39) and is equipped with a plurality of rotating folding fingers (110) which are mounted so as to be elastically pivotable, and which, as a result of the rotation of the folding unit (109) at a higher speed, grasp the inner tab (108) and fold it round against the side face (28).

23. Apparatus according to claim 1, characterised in that a cigarette group is fed to the folding turret (20) by means of an endless conveyor, in the form of a pocket chain (41) with pockets (42), each for receiving a cigarette group, and the pocket chain (41) is guided up to the periphery of the folding turret (20) in a lower region located opposite the blank feeding unit (32), in such a way that the pocket chain (41), with pockets (42) aligned with the hollow mandrels (23) is guided on the side of a turret disc (24) located opposite the projecting hollow mandrels (23).

24. Apparatus according to claim 23, characterised in that, on the side of the turret disc (24) facing away from the hollow mandrels (23), the folding turret (20) has a cylindrical supporting part (119) which is connected to the turret disc (24) and which is provided, adjacent to the turret disc (24), with a depression (120) extending all round for receiving the pocket chain (41), there being assigned to each hollow mandrel (23) a displaceable pushing-out ram (124) which is guided in the supporting part (119) and which can be moved out of an initial position outside the range of movement of the pocket chain (41) inside the depression (120) through the pocket (42) and through the hollow mandrel extending in the same axis.

25. Apparatus according to claim 23, characterised in that the pushingout rams (124) are movable via guide rollers (125) by means of a guide groove (126) extending in the outer surface of a pot-like or cylindrical control body (127) which is arranged fixedly in the same axis as the folding turret (20).

26. Apparatus according to claim 25, characterised in that the cylindrical control body (127) is joined to the control wall (128) to form a common moulding mounted immovably on the turret shaft (118).

27. Apparatus according to claim 24, characterised in that, outside the region where the pocket chain (41) comes up against the folding turret (20), the ram (124) is moved into an end position in which a ram end plate (133) attached to the end of the ram is flush with the free open end of the hollow mandrel (23).

28. Apparatus according to claim 24, characterised in that the pocket chain (41) is guided in the depression (120) against lateral movements, especially as a result of the penetration of an extension (122) on each pocket (42) into a guide trough (121) extending all round in the supporting part (119).

29. Apparatus for producing soft-cup cigarette packs from at least one foldable blank (20, 21), in which, in a transfer station (35, 36), a blank-feeding unit (31, 32), including a blank-holder, feeds individual blanks (21, 22) to a receptacle, in the form of a hollow U-shaped mandrel (23), of a folding turret, and each blank is transported by the mandrel in order to make folds in the blank, characterised in that:

said blank holder comprises a holding disc (68) which holds each blank (21, 22) for taking up by a hollow mandrel (23) of the folding turret (20), the blank being held so as to project freely on one side said holding disc (68) being stationary and arranged outside the path of movement of the mandrels (23);

the blank-holder is designed as an intermittently driven holding disc (68) having a peripheral surface on which only a lateral edge strip of the blank (21, 22) is held by means of suction air;

said holding disc (68) holds the blank (21, 22), so that the blank surrounds the holding disc (68) along only a part of the peripheral surface thereof, in such a way that the blank assumes the form of a stable part cylinder having a gap for permitting the entry of a hollow mandrel into the blank (21, 22), the gap being formed on the blank's side located at the rear in the conveying direction of the respective mandrels (23);

there is provided means for fixing the blank (21, 22), immediately after the blank is received by a hollow mandrel (23), the blank in the region of a front narrow side face (27) of the mandrel and subsequently in the region of a wider inner face (29) and opposite outer face (30);

said fixing means comprises first and second pressing devices (94, 106) which are advanced alternately towards the front and a rear side face (27, 28) of the hollow mandrel (23) in order to fix parts of the blanks (21, 22) to the mandrel; and said first and second pressing devices (94, 106) being arranged between successive hollow mandrels (23) said two pressing devices (94, 106) being separately pivotable and being of differing designs, and of which a first pressing device (94), serving for fixing to the mandrel the blank (21, 22) received by a hollow mandrel (23), is provided with a hollow U-shaped profile open on one side, and the other pressing device (106) is provided with a pressing rod which projects on one side and which penetrates into the hollow profile of the first pressing device (94).

* * * * *